US006019461A

United States Patent [19]

Yoshimura et al.

[11] Patent Number: 6,019,461

[45] **Date of Patent: *Feb. 1, 2000**

[54] PRINTER AND PRINTING CARTRIDGE THEREFOR

[75] Inventors: Kotaro Yoshimura; Tomonori Watabe, both of Tokyo, Japan

[73] Assignee: Oki Data Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/641,701

[22] Filed: May 2, 1996

[30] Foreign Application Priority Data

May 19, 1995 [JP] Japan ..... 7-121052

[51] Int. Cl.[7] ..... B41J 2/175

[52] U.S. Cl. ..... 347/86; 347/19; 347/49; 347/85; 347/87; 399/12; 399/13; 399/25

[58] Field of Search ..... 347/7, 19, 43, 347/85, 86, 87, 49; 73/304 C; 399/12, 13, 25, 26

[56] References Cited

U.S. PATENT DOCUMENTS

| | | | |
|---|---|---|---|
| 1,709,926 | 4/1929 | Weaver | 347/43 |
| 4,367,482 | 1/1983 | Heinzl | 346/140 R |
| 4,631,548 | 12/1986 | Milbrandt | 346/1.1 |
| 5,049,898 | 9/1991 | Arthur et al. | 346/1.1 |
| 5,068,806 | 11/1991 | Gatten | 395/113 |
| 5,367,363 | 11/1994 | Kia et al. | 355/210 |
| 5,500,988 | 3/1996 | Moynihan et al. | 29/25.35 |
| 5,506,611 | 4/1996 | Ujita et al. | 347/86 |
| 5,528,269 | 6/1996 | Drogo et al. | 347/19 |

OTHER PUBLICATIONS

Radio Shack Dictionary of Electronics; Rudof Graf; Radio Shack; Fort Worth, Texas; pp. 81, 399, and 477, 1974.

*Primary Examiner*—John Barlow
*Assistant Examiner*—Christina Annick
*Attorney, Agent, or Firm*—Rabin & Champagne, P.C.

[57] ABSTRACT

An ink cartridge is removably attached to a serial printer. The ink cartridge has a memory device in which information on the ink cartridge is stored. The information may include information such as viscosity, temperature coefficient, the hue and brightness of color ink, various user's settings of density of a printed image and color tone of a printed color image, and identification data indicative of a kind of the ink cartridge. A controller in the printer determines whether the attached cartridge is suitable for use with the printer, by comparing the identification data read from the ink cartridge with the reference data stored in the printer. The information may also include data of a maximum count of dots that the ink cartridge is capable of printing and data of a cumulative count of printed dots that the cartridge has printed. The printer includes an adder for producing sum of a number of dots currently being printed and the cumulative count of dots, and stores the sum as a new cumulative count into the ink cartridge. The printer indicates to the user when the ink of the cartridge is about to run out. A capacitor having a capacitance value corresponding to a kind of the ink cartridge may be provided in the cartridge. The printer generates data similar to the identification data to identify a kind of ink cartridge.

6 Claims, 4 Drawing Sheets

PRINTER AND PRINTING CARTRIDGE THEREFOR

BACKGROUND OF THE INVENTION

The present invention relates to a serial printer in which print operation is performed by using the ink supplied from an ink cartridge attached to the printer. The term "ink cartridge" is used in this specification to cover both an ink cartridge, in a narrow sense, used in ink jet printers and an ink ribbon cartridge used in impact printers.

Serial printers such as an ink-jet printer and an impact printer use an ink cartridge detachably attached to the printer. For example, when the ink in the cartridge has been used up or the ink ribbon has been dried up due to a large volume of print or long period of use, the ink cartridge is replaced with a new, unused cartridge.

Generally, a serial printer is designed to use the ink specially designed for the printer. An accidental use of an ink cartridge having different ink characteristics of the designed ink will result in poor print quality and/or damage to the print head. For example, for ink jet printers, differences in ink viscosity cause troubles such as poor print quality and clogging of the nozzle of the print head. For impact printers, differences in composition of the ink of the ink ribbon will cause the pins of the print head to rapidly wear out and greatly decreases the life of the print head.

In order to determine whether the ink cartridge attached to the printer is a proper type, each type of ink cartridge is conventionally provided with a particular projection and the projection is detected by the printer when attached to the printer. Alternatively, an ink cartridge is provided with a piece of permanent magnet and the magnet is detected by a Hall-sensor in the printer. However, the problem is that it is difficult to determine whether or not an ink cartridge is suitable for use with the printer if the ink cartridge is filled with ink not suitable for use with that serial printer but is of the same shape as or very close in physical shape to the cartridge filled with suitable ink. If an ink cartridge is designed to be too simple to check whether or not the cartridge is suitable for use with that printer, copy products of that type of ink cartridge may readily be produced, leading the users to accidental use of an ink cartridge not suitable for the printer.

SUMMARY OF THE INVENTION

An object of the invention is to provide a serial printer in which ink cartridges having close physical appearance are identified so that the users are prevented from using the wrong cartridge or a copy product having unsuitable ink quality.

Another object of the invention is to provide a serial printer in which printing operation is carried out in accordance with the characteristics of the ink in the ink cartridge.

A still another object of the invention is to provide a serial printer in which the operator may write particular settings according to the operator's desire into a writable non-volatile memory of the ink cartridge, so that attaching the cartridge to the printer immediately allows the operator to make print with the desired print conditions.

An ink cartridge is provided with a memory device in which information on the ink cartridge is stored. The information may include viscosity and temperature coefficient of the ink, the hue and brightness of color ink, individual user's settings of density of a printed image and color tone of a printed color image, and identification data indicative of a kind of ink in the ink cartridge. The identification data is stored in a first memory of the ink cartridge. The printer includes a controller that compares the identification data read from the ink cartridge with the reference data in the printer to determine whether the identification data matches the reference data. The ink cartridge may include a second memory in which data indicative of a maximum number of dots that the ink cartridge is capable of printing is stored, and a third memory in which a cumulative number of printed dots is stored. The controller includes a bit adder for producing number of dots currently being printed and the cumulative number of dots stored in the third memory, and stores the sum as a new cumulative number of dots into the third memory. When the difference between the cumulative number of dots and the maximum number of dots is less than a certain value, the controller indicates to the user that the ink of the cartridge is about to run out.

DETAILED DESCRIPTION OF THE INVENTION

Embodiments of the invention will now be described in detail with reference to the drawings. Like elements have been given like numerals throughout the drawings. The present invention will be described with respect to an ink-jet printer as a serial printer.

First Embodiment

Figure 1:
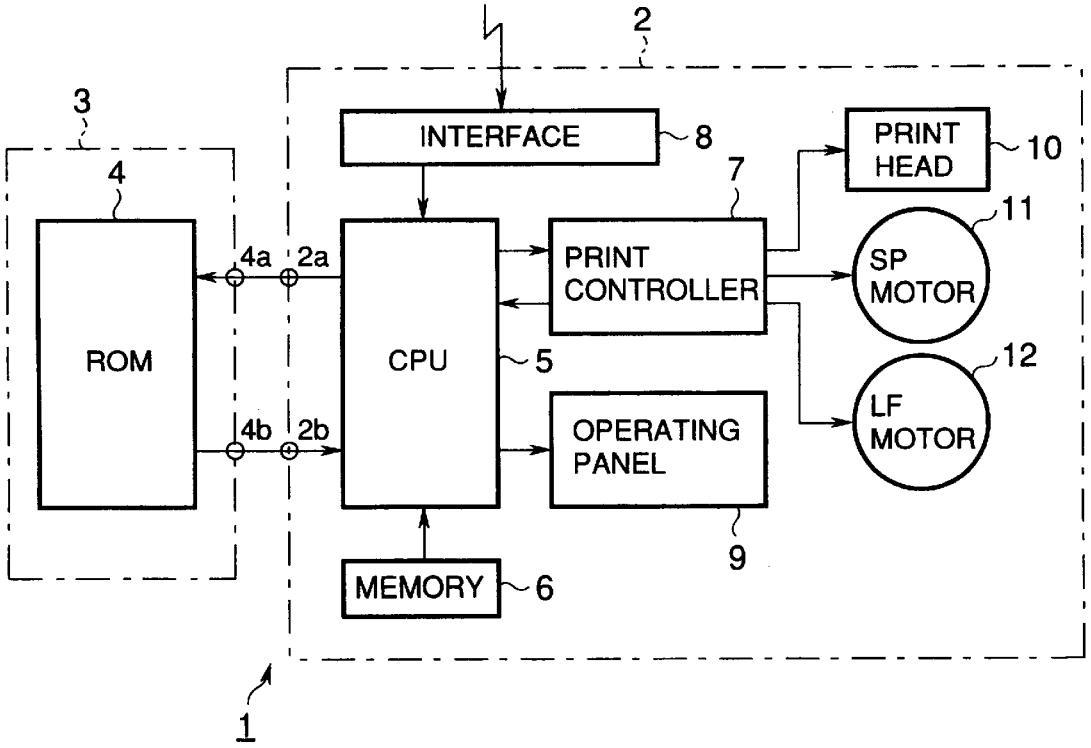
FIG. 1 is a block diagram showing a serial printer according to a first embodiment of the invention.

FIG. 1 is a block diagram showing a serial printer according to a first embodiment of the invention.

A serial printer 1 includes a printer body 2 and an ink cartridge 3 which is attached to the printer body 2. The printer body 2 incorporates a controller 5 (referred to as CPU 5 hereinafter) for controlling the entire operation of the serial printer 1. The CPU 5 communicates with a print controller 7 for controlling print operation, interface 8 for receiving data to be printed from a host system, a memory 6 in which a control program and data are stored, and operating panel 9. The print controller 7 communicates with a print head 10, spacing motor 11 (SP motor 11) for spacing operation of a carriage, and a line-feed motor 12 (LF motor 12) for transporting the paper line by line. The print controller 7 receives print data and a print-initiating signal from the CPU 5, and carries out printing operation of the received data. The operating panel 9 is provided with lamps, not shown, which indicates the operating conditions of the serial printer 1 to the operator.

The ink cartridge 3 is detachably mounted to the carriage, not shown, in the printer body 2. The ink cartridge 3 incorporates a ROM 4 in which one item of identification data indicative of the kind of ink in the ink cartridge is stored. The ROM 4 has connection terminals 4*a* and 4*b*, which are connected to a connector, not shown, on the carriage when the ink cartridge 3 is mounted to the cartridge. The connector is in turn connected to the CPU 5 in the printer body 2. The reference data is previously stored in the memory 6, which reference data is the same data as the identification data of the ink cartridge 3 filled with ink usable for the serial printer 1.

The cartridge-identifying operation for identifying a kind of ink cartridge according to the first embodiment will be now described.

When the CPU 5 receives the data to be printed via the interface 8 from a host system with the ink cartridge 3 attached to the printer body 2, the CPU 5 reads the identification data stored in the ROM 4 of the ink cartridge 3. The address in the ROM 4 for accessing the identification data is specified in the control program which is run by the CPU 5. The CPU 5 reads the reference data from the memory 6 and compares the reference data with the identification data. If the reference data matches the identification data, the CPU 5 determines that the ink cartridge 3 is filled with suitable ink, and therefore the CPU 5 outputs the received print data and the print initiating signal to the print controller 7. The print controller 7 drives the print head 10 to print in response to the command.

When the identification data does not match the reference data, the CPU 5 determines that the ink cartridge is filled with ink not suitable for use with the printer. The CPU therefore does not output a print initiation signal to the print controller 7. The lamp of the operation panel 9 indicates to the operator that the ink cartridge 3 should be replaced.

As mentioned above, when the CPU 5 receives the print data, a check is made to determine whether the attached ink cartridge is suitable for use with the printer. The check may also be made when the serial printer is turned on or shortly after the cartridge is replaced. In such cases, the serial printer does not perform print operation but enters standby condition if the identification data matches the reference data.

Although the first embodiment has been described with respect to the ROM 4 in which only one item of identification data is stored, a combination of a plurality of items of data may also be stored for enhanced protection. The ROM 4 may be protected against copying, so that the data will be destroyed if one attempts to copy the identification data in the ROM 4, thereby preventing one from making a copy product of the ink cartridge.

In the first embodiment, the identification data is stored in a passive circuit such as a ROM. The identification data may also be stored in an active circuit such as a combinatorial logic circuit, CPU, and so on for the similar result.

The data stored in the ROM 4 may include ink data indicative of the characteristics of the ink in the cartridge. If the ROM 4 includes both the identification data and the ink data, the CPU 5 first reads the identification data to identify the cartridge to determine whether the cartridge is suitable for use with the printer, and then reads the ink characteristics data if the identification data matches the reference data. The CPU 5 then controls the printing operation of the data in accordance with the ink characteristics data.

For example, if the ink characteristics data includes the values of viscosity and temperature coefficient of the ink, the CPU 5 determines drive voltage and drive time in accordance with the values of viscosity and coefficient read from the ROM 4 and ambient temperature. For higher values of the ink viscosity, the CPU 5 increases the drive voltage of the print head 10 or applies the drive signal for a longer time. For lower values of the ink viscosity, the CPU 5 decreases the drive voltage of the print head 10 or applies the drive signal for a shorter time. The print head of the first embodiment may be equipped with a temperature detecting means and the CPU 5 reads the detected temperature so as to calculate the viscosity of ink at the detected temperature from the temperature and viscosity versus temperature characteristic. Then, the CPU selects the value and the waveform of the drive voltage of the print head 10 in accordance with the derived viscosity, thereby properly driving the print head in accordance with environmental condition for quality print.

If the ink characteristic data includes time required for the ink to dry up, the CPU 5 extends a waiting time between the completion of the printing of one line and the starting of the next scanning if the dry-up time is relatively long, or transports the printed paper more slowly so that there is enough time for the ink to dry up before discharge of the printed paper. This mode of operation eliminates poor print quality due to splash of ink when ink is jetted onto an area of the paper where previously jetted ink droplets are still wet, or prevents the still wet ink from soiling the printed side of the paper when the user takes up the printed paper.

If the printer is designed to perform color print, an ink cartridge filled with primary colors is used so as to produce composite colors by mixing the primary colors. The ink characteristic data includes information on the hue and brightness of primary colors, so that the proportion of ink of the respective color to be mixed is determined by the information for printing desired color. In other words, for example, if a cartridge is filled with three kinds of ink, i.e., yellow, magenta, and cyan, the proportion of the ink amount may be different from a cartridge filled with three kinds of ink, i.e., red, green, and blue. Even if a cartridge is a type which uses yellow, magenta, and cyan, the proportion may still be changed if the yellow, magenta, and cyan have different brightness from each other. This change in proportion allows color print to be adjusted in accordance with the colors of ink in the ink cartridge, increasing repeatability of the same tones of color to improve color print quality.

The print operation may be controlled by using the data of the characteristics of the ink stored in the ROM of the ink cartridge. This is advantageous if ink cartridges are available in some variations or a new kind of cartridge is to be added to the existing product line. When a new type of ink contains different compositions so that ink exhibits entirely new characteristics, simply writing the data of the new kind of ink into the ROM ensures optimum printing operation without a need for changing or readjusting the control parameters on the printer side. This enhances the versatility of the printer. In addition to the data of the characteristics of ink, the date of manufacture of the ink cartridge may be stored in the ROM. A calendar function may be incorporated in the printer and the CPU 5 compares the current date sent from the host apparatus with the manufacture date stored in the ROM of the ink cartridge to determine the elapsed time from when the ink cartridge was manufactured. Printing operation may be prohibited if the elapsed time is too long, thereby preventing detrimental effects which result from the use of too old ink. This improves reliability of the printer.

Second Embodiment

Figure 2:
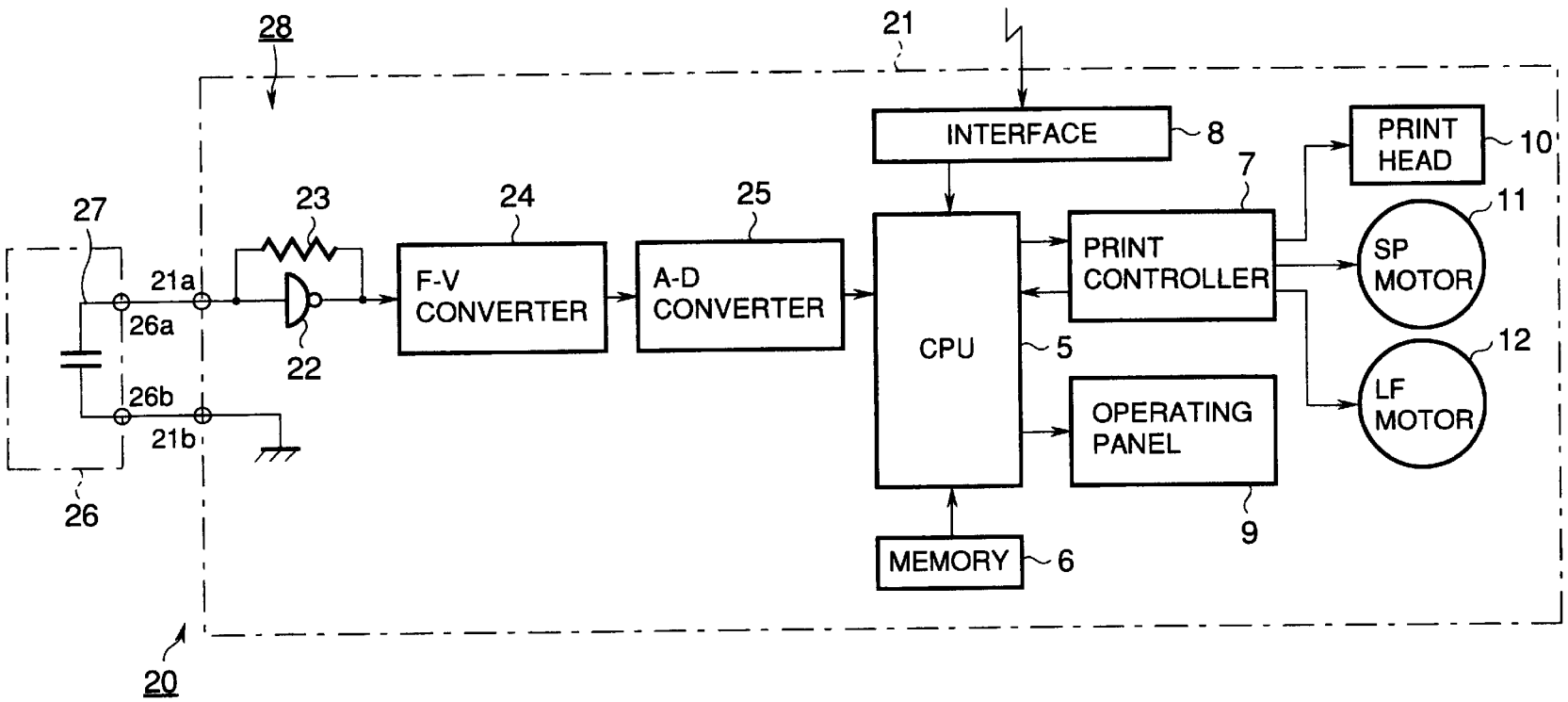
FIG. 2 is a block diagram showing a serial printer of a second embodiment.

The ink cartridge 3 of the first embodiment includes the ROM 4. A second embodiment employs a capacitor 27 in place of the ROM 4. FIG. 2 is a block diagram of a serial printer of the second embodiment.

The printer body 21 of the serial printer 20 includes an inverting amplifier 22 (hereinafter referred to as inverter 22), feedback resistor 23 through which the output of the inverter 22 is fed back to the input of the inverter 22, F/V converter 24 that receives the output of the inverter 22, and A/D converter 25 that receives the output of the F/V converter 24. The CPU 5 receives the output of the A/D converter 25.

The ink cartridge 26 incorporates the capacitor 27, the leads of which, not shown, are exposed. The leads are electrically connected to the input of the inverter 22 when the ink cartridge is attached to the printer. The feedback resistor 23, capacitor 27, and inverter 22 form an oscillator 28 having a frequency determined by the electrical characteristics of these circuit elements. The capacitance value of the capacitor 27 represents a particular type or model of that ink cartridge, so that the inverter 22 outputs a frequency indicative of the type or model of that ink cartridge when the ink cartridge 26 is attached to the carriage. The output frequency of the inverter 22 is converted by the F/V converter 24 into a voltage which in turn is converted by the AID converter 25 into a digital value. The digital signal is then inputted into the CPU 5.

The rest of the construction of the ink cartridge is the same and the description thereof is omitted.

The printing operation of the serial printer 20 according to the second embodiment will be described.

Upon attaching the ink cartridge 26 to the printer body 21, the capacitor 27 in the cartridge 26 is electrically connected to the input of the inverter 22, and the output frequency of the oscillator 28 is directed to the F/V converter 24. The F/V converter 24 provides an analog voltage corresponding to the capacitor value to the A/D converter 25. The A/D converter 25 converts the voltage into a digital value. The CPU 5 reads the digital signal as identification data of the ink cartridge and compares the read identification data with the reference data. If the identification data matches the reference data, then the CPU 5 determines that the ink cartridge 26 attached to the printer is filled with ink suitable for use with the printer. It may be so arranged that the identification data is found to match the reference data if the identification data is within a certain range associated with, e.g., centered on the reference data. If the CPU 5 has not received print data from the host apparatus via the interface 8, the CPU 5 enters standby condition; if the CPU 5 has received print data, the CPU 5 supplies the received data and print initiating signal to the print controller 7. The print controller 7 causes the print head 10 to initiate printing operation.

If the identification data does not match the reference data, the subsequent operation is the same as in the first embodiment and therefore the description of the operation is omitted. A check for identifying the ink cartridge 26 may also be performed upon turning on the serial printer or shortly after replacement of ink cartridge.

In the second embodiment, the ink cartridge is identified in terms of the output frequency of the oscillator 28. Therefore, even if one makes a copy product of the ink cartridge by employing ink suitable for use with the printer, such a copy product will not work properly unless the capacitance is made with a high accuracy to resemble the capacitance value of the genuine product reproduced.

The use of a capacitor makes the ink cartridge of the second embodiment more economical than that of the first embodiment which uses a ROM.

Although the cartridge of the second embodiment incorporates a capacitor, the capacitor may be replaced with an inductor having an inductance indicative of the type or model of ink suitable for use with the printer.

Third Embodiment

Figure 3:
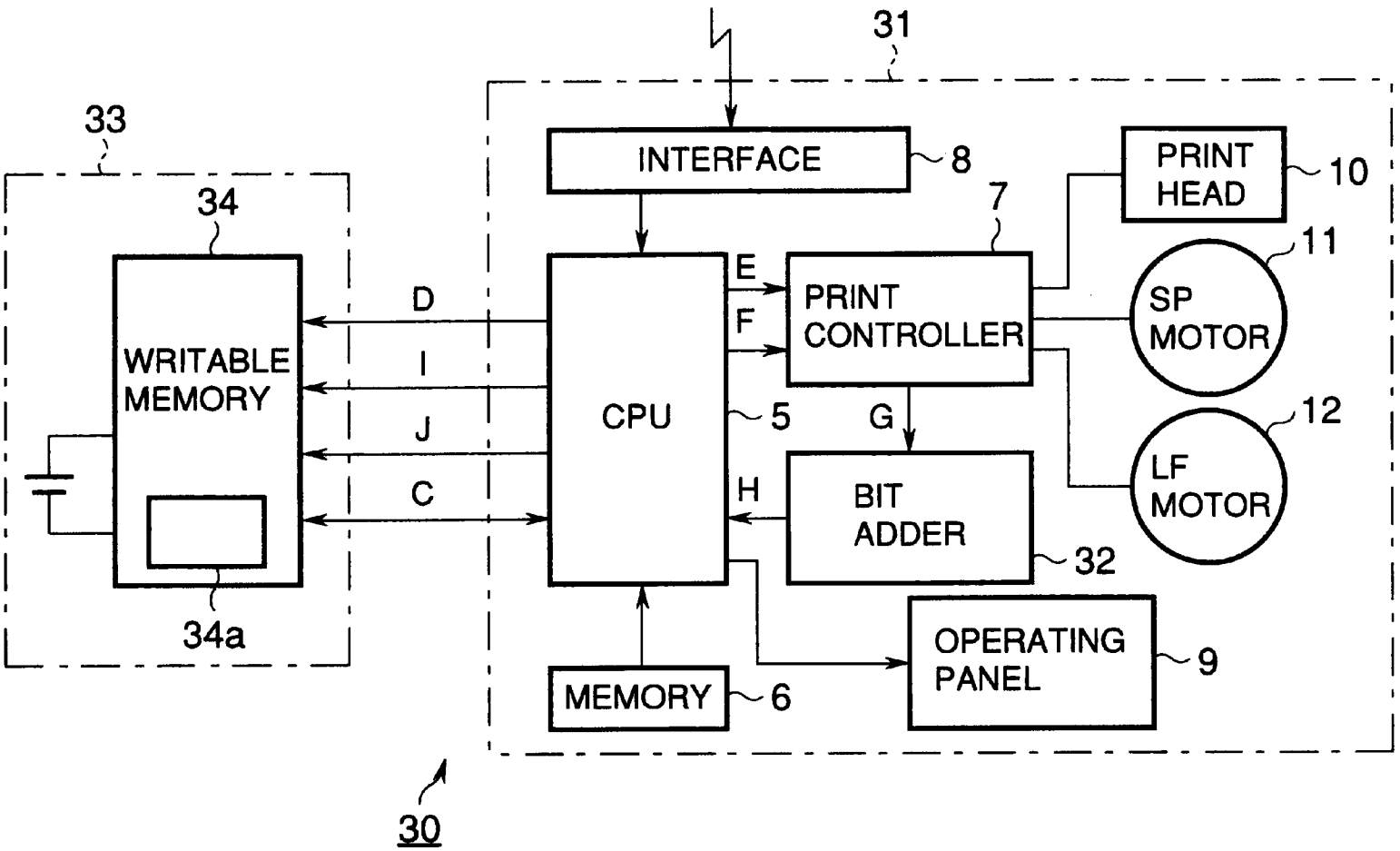
FIG. 3 is a block diagram showing a serial printer of a third embodiment.

According to a third embodiment, an ink cartridge incorporates a writable memory 34, and the printer body 31 of the printer 30 is equipped with a bit adder 32 that counts the number of bits of input data. The writable memory may be replaced by a battery backup memory such as RAM or a non-volatile memory such as EPROM and $E^2$PROM. FIG. 3 is a block diagram of a serial printer of the third embodiment.

The print controller 7 sends bits of logic 1 level to the bit adder 32 which counts the number of input bits and sends its count to the CPU 5. The count is any value from 0 to n, n being the maximum number of dots of the print head 10. The CPU 5 incorporates a register A, register B, and an adder, all being not shown. The register A temporarily stores the aforementioned count and the adder adds the content in the register A to the content in the register B. The sum is then outputted to the ink cartridge 33.

The writable memory 34 previously stores a single value of identification data indicative of the kind of ink, not shown, filled in the ink cartridge 33 as well as data indicative of the maximum count of dots that may be printed using the cartridge filled up with ink. The writable memory 34 also includes a stack region 34*a* in which the count of the adder in the CPU is stored as cumulative count outputted from the CPU 5. A new, unused cartridge has a cumulative count of zero. The writable memory 34 is provided with connection terminals, not shown, which connect the connector provided on the carriage just as in the first embodiment upon attaching the ink cartridge 33 to the carriage.

The rest of the construction is the same as that of the first embodiment and description thereof is omitted.

Figure 4:
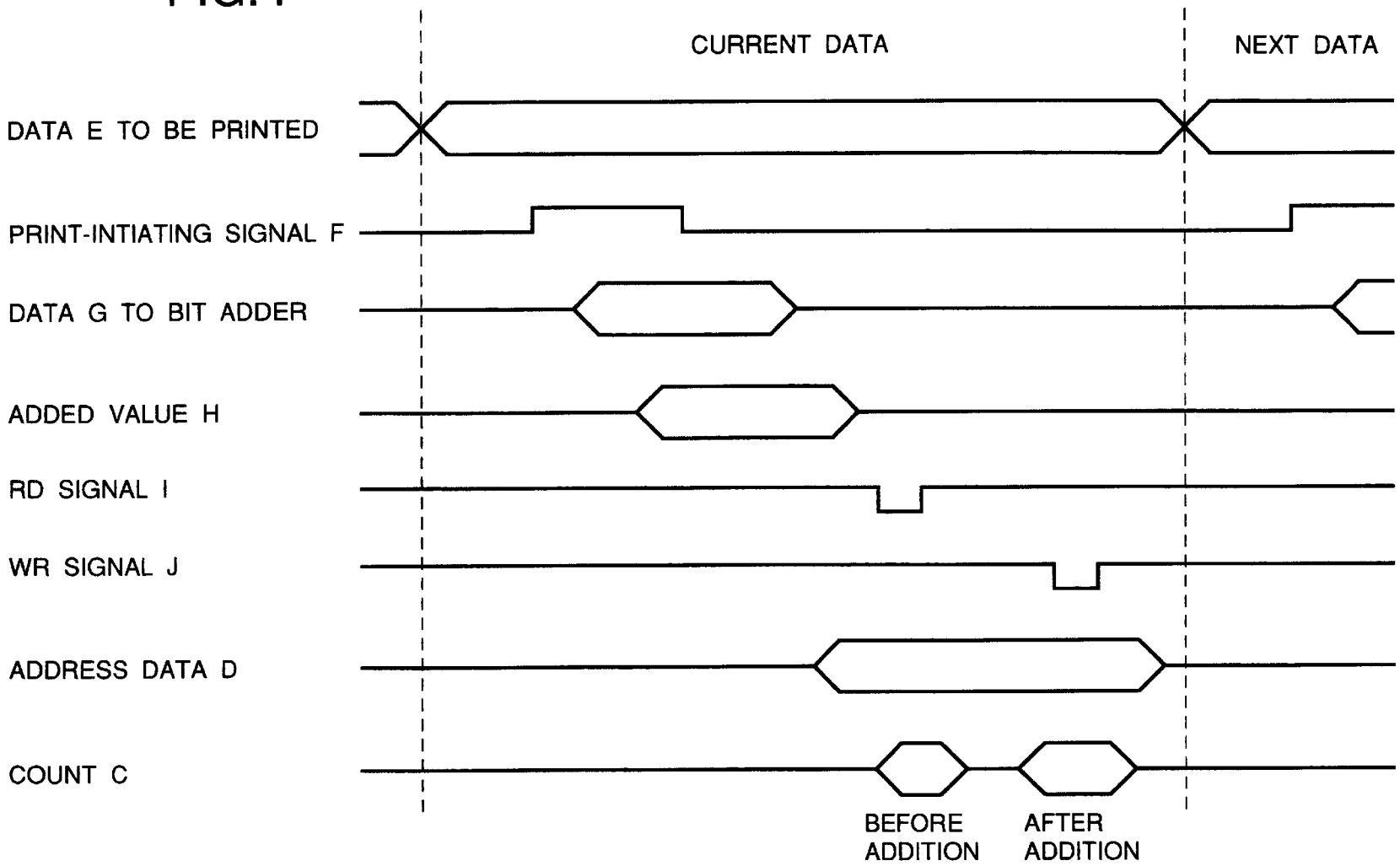
FIG. 4 is a timing chart of the serial printer of the third embodiment.

The operation of identifying the ink cartridge 33 of the serial printer according to the third embodiment will be described with reference to FIGS. 3 and 4. FIG. 4 is a timing chart of the serial printer 30 of the third embodiment.

When the CPU 5 receives print data E via the interface 8 from a host apparatus for the first time after replacement of cartridge 33, the CPU 5 temporarily holds the print data E in the memory 6 and reads the identification data stored in the writable memory 34 of the ink cartridge 33. The control program resident in the CPU 5 contains the address data D for accessing the identification data in the writable memory 34. The CPU 5 reads the reference data stored in the memory 6 and compares the reference data with the identification data. If the identification data matches the reference data, the CPU 5 determines that the attached ink cartridge is filled with ink suitable for use with the printer, and thus reads the print data E temporarily held in the memory 6 in accordance with a spacing timing of the print head 10. The CPU 5 sends the print data E, which was read out of the memory 6, to the print controller 7 and a print initiating signal F to the print controller 7.

If the identification data does not match the reference data, then the printer operates just as in the first embodiment and therefore description thereof is omitted.

A check for identifying the ink cartridge 26 may also be performed upon turning on the serial printer 31 or shortly after replacement of the cartridge 33.

Upon receiving the print initiating signal F from the CPU 5, the print controller 7 causes the print head 10 to print the dots corresponding to the print data E and also outputs the same print data to the bit adder 32. The bit adder 32 cumulatively counts the input bits received from the print controller 7, and outputs its count H to the CPU 5. The CPU 5 temporarily holds the count H in the register A, and outputs an RD signal I (read signal) to the writable memory 34 to read the cumulative count C stored in the stack region 34*a* and then store the cumulative count C into the register B. The RD signal I controls the timing at which the count C is read out of the stack region 34*a*. The CPU 5 then adds the contents (H and C) in the registers A and B together and the sum is stored as a new cumulative count C back into the stack region 34*a* when the CPU 5 outputs a WR signal J to the writable memory 34. The WR signal J controls the timing at which the aforementioned sum (H+C) is written into the writable memory 34.

The CPU 5 reads the data indicative of the maximum number of dots from the battery backup memory 34 and then compares the data with the cumulative count outputted from the adder in the CPU 5 to detect the number of remaining dots indicative of the residual amount of ink. The difference between the maximum number of dots and the count outputted from the adder in the CPU 5 indicates the number of bits that the ink cartridge can still print. When the difference has decreased to a small number, a "near end" lamp on the operation panel 9 comes on indicating to the user that the ink is about to run out, and an "ink end" lamp comes on when the number of remaining dots is zero indicating that the ink has been used up.

The aforementioned operation is performed in every printing operation of data.

In the third embodiment, when the cartridge is replaced with a partly-used cartridge, the number of remaining dots of the partly used cartridge may be readily calculated. Thus, it is more advantageous to store the number of printed dots into the writable memory 34 of the ink cartridge 33 than into the printer.

Some printers allow the operator to adjust the brightness of a printed image and the tone of a printed color image to the operator's desire. Desired density of an image and color tone can be obtained by controlling discharge amount of ink in accordance with the settings. The operator's settings may be previously written into a writable memory provided in the ink cartridge and the discharge amount of ink may be controlled in accordance with the settings. This eliminates the need for making adjustments of the printer by the operator every time such a type of ink cartridge is attached to the printer. Writing desired settings into the ink cartridge eliminates the need for adjustment of printer when the operator uses the same ink cartridge with another printer or when the ink cartridge is replaced. The operator simply attaches the ink cartridge to that printer and the same picture quality is obtained. This eliminates complex steps when operating a printer. Standard settings may be previously stored in the ink cartridge during manufacture of the cartridge so that the printing operation is carried out in accordance with the standard settings if the operator does not particularly want to print with his desired settings.

The invention has been described with reference to an ink jet printer, the invention may be applicable to a wire dot type serial printer using an ink ribbon as an ink cartridge.

What is claimed is:

1. A printer apparatus, comprising:

a printer; and a print cartridge coupled to the printer;

wherein the print cartridge includes a reactor having a reactance value indicative of a kind of the print cartridge; and first terminals connected to the reactor for coupling to the printer; and wherein the printer includes memory in which reference data is stored, the reference data indicating a kind of print cartridge suitable for use with the printer;

second terminals coupled to the first terminals;

circuit elements, connected to said second terminals, which are electrically connected to said reactor through said first terminals, wherein the circuit elements and the reactor together form a circuit that produces cartridge data indicative of the kind of the print cartridge, based on the reactance value; and a controller for receiving the cartridge data and the reference data and for carrying out a printing operation only when the cartridge data corresponds to said reference data;

wherein said circuit is an oscillator that generates a signal having a frequency corresponding to said reactance value to identify the kind of the print cartridge indicated by the reactance value.

2. The printer apparatus according to claim 1, wherein the reactor is a capacitor.

3. The printer apparatus of claim 1, wherein the reactor is a discrete reactive element.

4. The printer apparatus of claim 2, wherein the capacitor is a discrete capacitor device.

5. The printer apparatus of claim 1, wherein the print cartridge further includes, in addition to the reactor, ink corresponding to the kind of the print cartridge.

6. The printer apparatus of claim 5, wherein the printer further includes, in addition to the circuit elements, a print head, a spacing motor, and a line-feed motor.

* * * * *